United States Patent [19]

Weixel

[11] Patent Number: 4,718,633

[45] Date of Patent: Jan. 12, 1988

[54] WIRE CONTAINER

[75] Inventor: Mark Weixel, Ellicott City, Md.

[73] Assignee: The United States of America as represented by the Secretary of the Air Force, Washington, D.C.

[21] Appl. No.: 17,399

[22] Filed: Feb. 24, 1987

[51] Int. Cl.[4] ..... B65H 49/00

[52] U.S. Cl. ..... 242/129; 242/54 R; 242/117; 242/118.4; 242/125.1

[58] Field of Search ..... 242/129, 128, 127, 129.5, 242/130, 137, 137.1, 146, 132, 117, 54 R, 125.1, 159, 170, 171, 1, 118.4

[56] References Cited

U.S. PATENT DOCUMENTS

| | | | |
|---|---|---|---|
| 2,811,322 | 10/1957 | Wilkinson | 242/117 |
| 2,846,162 | 8/1958 | Allin, Sr. et al. | 242/117 |
| 2,987,267 | 6/1961 | Hayes et al. | 242/125.1 |
| 3,907,228 | 9/1975 | Lewis | 242/129 |
| 4,089,486 | 5/1978 | Carter | 242/129 |
| 4,531,682 | 7/1985 | Schroder et al. | 242/129 X |
| 4,638,558 | 1/1987 | Eaton | 242/129 X |

*Primary Examiner*—Stanley N. Gilreath

*Attorney, Agent, or Firm*—Richard J. Donahue; Donald J. Singer

[57] ABSTRACT

A wire container for use with a robot-arm-manipulated wire routing tool in the fabrication of wire harnesses. The container includes a protective shroud having a plurality of lever arms which facilitate the raising of the shroud above the drum of the container.

6 Claims, 11 Drawing Figures

WIRE CONTAINER

STATEMENT OF GOVERNMENT INTEREST

The invention described herein may be manufactured and used by or for the Government for governmental purposes without the payment of any royalty thereon.

BACKGROUND OF THE INVENTION

This invention relates generally to wire containers and more specifically to a wire container for use in conjunction with a robot-arm-manipulated wire routing tool in the fabrication of wire harnesses.

A completed wire harness typically comprises a multiplicity of wires configured in a desired bundled layout, with the ends of each wire being terminated in a desired manner. For example, each such wire may have a contact affixed to each of its ends, where each contact is to be inserted into a contact holding device, such as a connector plug. In complex arrangements, numerous wires of varying lengths and types can be included in a single wire harness. Furthermore, such wires may require different contact configurations at their respective ends. In these situations, the task of producing wire harnesses becomes a particularly laborious and time consuming task.

Fully automated fabrication is a sought-after goal in the cost effective production of wire harnesses. Such wire harnesses are preferably assembled by means of manipulable tools, sometimes called end-effectors, which are attached to robotic arms and can route wires in predetermined paths, or insert contacts of varying styles into connectors, or both.

An example of a combined contact insertion and wire routing tool for manufacturing wire harnesses is disclosed in U.S. Pat. No. 4,549,347, issued to C. M. Travlos et al on Oct. 29, 1985. Another contact insertion type end-effector tool for use in the robotic assembly of wire harnesses is disclosed in U.S. Pat. No. 4,598,469, issued to M. S. Weixel on July 8, 1986.

Specific steps involved in the automated fabrication of wire harnesses include the unloading of a wire from a wire prep station, loading the wire into a wire container, transporting the wire container to a wire harness formation station, loading the wire container onto the wire routing end-effector tool, routing the wire within the wire container along a predetermined two-dimensional path, and terminating both wire ends.

To date, the approach usually taken to automate the robotic fabrication of a wire harness is the two-arm approach. It consists of using a robot having two arms, the first arm having a wire routing end-effector tool thereon capable of receiving a wire container, placing a wire end into a holder at the harness formation station, routing a specified length of wire along a two-dimensional path, and placing the second wire end into a holder. If the buffered wire end is a contact that requires an insertion into a connector, then a second robot arm which manipulates a contact insertion type end-effector tool will retrieve the contact and proceed to perform a contact insertion while the next wire container is being loaded onto the first robot arm. This action continues on a wire-by-wire basis until all of the wires are routed and properly terminated. In this two-arm robot approach, the wire routing end-effector tool is not responsible for performing contact insertions.

One of the important elements of such an automated wire harness formation station is the wire containing device. It must be constructed to simplify loading of a wire into the container at a wire prep station, be readily transportable from the wire prep station to a wire harness formation station without damaging the wire or its contact terminations, and be tailored to the specific needs of the wire routing end-effector tool at the harness formation station.

Additional requirements affecting the wire container design include the capability, in certain instances, to route and terminate prepared single wires and cables of lengths ranging from 6 inches to 12 feet. Such wires may have American gauge conductor sizes ranging from 16 to 24, and insulation thicknesses of 0.003 to 0.010 inches. The cables to be held and dispensed by the container may consist of prepared coaxial wires, prepared twisted wire cables (twisted pairs being the most common) and shielded cables. The prepared cables may have outside diameters of up to 0.25 inches. Both wire and cables may have tinned ends, ends prepared with MIL-C-39029 crimp contacts or ends prepared with MS 25036 crimp lugs.

Various wire and cable containing and dispensing devices are presently known in the art. Examples of such devices are disclosed in U.S. Pat. Nos. 2,811,322; 2,846,162; 2,987,278; and 4,089,486. In U.S. Pat. No. 4,089,486 for example, the wire is dispensed from an enclosed container via an aperture in the wall of the container. With such an arrangememt, if the wires to be dispensed were to have contacts thereon, as in the applications discussed herein, the contacts would tend to snag on the wall of the container as they exited the closed container. Unfortunately no prior art containers exist which satisfy all of the criteria mentioned herein and a continuing need exists for improvements in such devices.

OBJECT OF THE INVENTION

It is therefore the primary object of the present invention to provide a wire container of improved design for use with an automated wire harness fabrication system.

SUMMARY OF THE INVENTION

In accordance with the present invention, a wire container is disclosed which can be used to hold a variety of wires and can be easily transported between the wire prep station and a wire harness station. The container comprises two subassemblies, a base member and a shroud member, that are joined in a manner to both protect the wire and facilitate the withdrawal and routing of the wire by a robot-arm-manipulated tool. The base member comprises a wire-holding drum having a base plate at one end thereof. A wire end clamp is recessed in a wire access slot in the base plate and a container mounting and registration hole is formed in the base plate at the longitudinal axis of the drum. The shroud member comprises a cylindrical rim which envelops the drum of the base member to protect the wire. A plurality of lever arms project from the rim of the shroud member and extend a part way towards its longitudinal axis. The lever arms are pivotally attached along their length to the free end of the drum to facilitate the raising of the rim of the shroud member from the surface of the base plate when the container is mounted on the wire routing end effector-tool.

BRIEF DESCRIPTION OF THE DRAWINGS

The foregoing and other objects, advantages and features of the invention will become apparent from the following detailed description of the preferred embodiments of the invention, as illustrated in the accompanying drawings, in which like reference characters refer to the same parts throughout the different views.

DETAILED DESCRIPTION OF THE INVENTION

Figure 1:
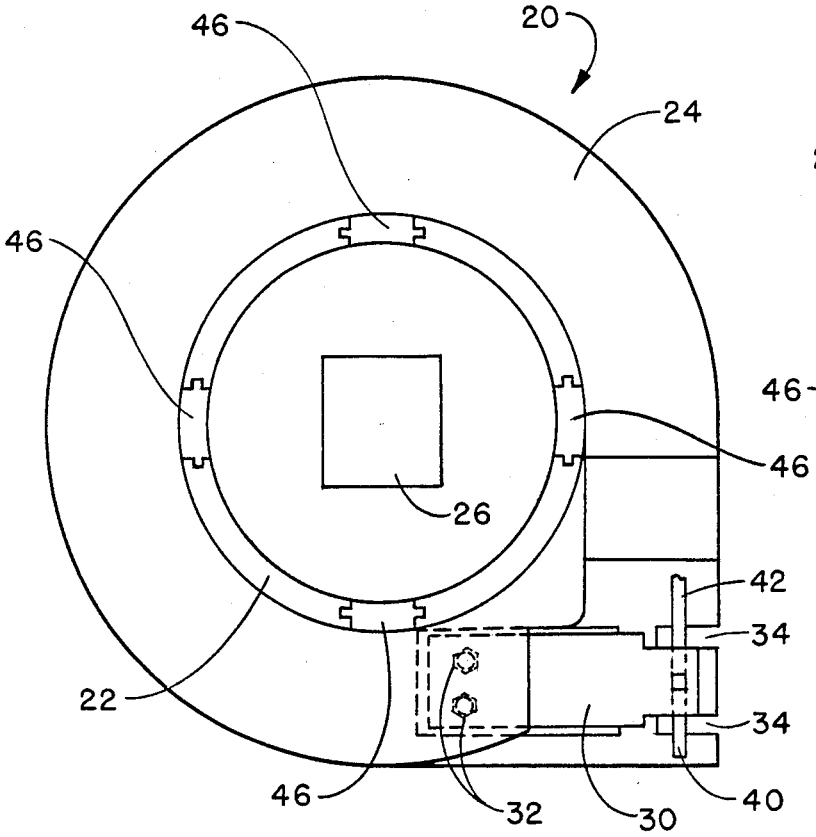
FIGS. 1, 2 and 3 are orthogonal side, front and bottom views respectively of the base member of the wire container of the present invention.
Figure 2:
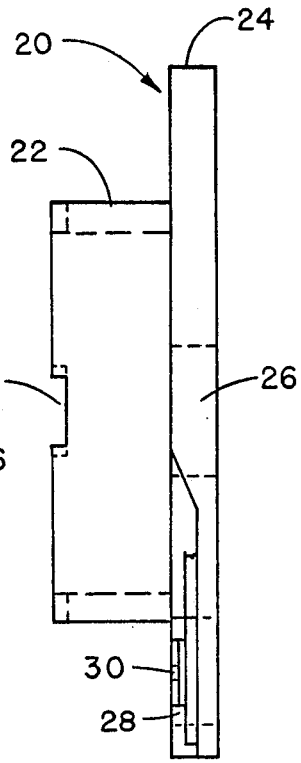
Figure 3:
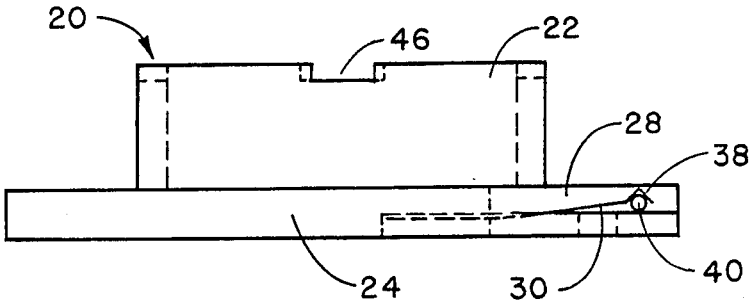

Referring now to the drawings, and in particular to FIGS. 1–3 thereof there are shown three orthogonal views of the preferred embodiment of the base member 20 of the present invention. Base member 20 is formed of plastic material and includes a cylindrical drum 22 having a flange-like base plate 24 at one end thereof. A container mounting and registration hole 26 is formed through base member 20 in alignment with the longitudinal axis of drum 22. It will be obvious that registration hole 26 may have different shapes than the rectangular shape depicted in the drawings.

Base plate 24 also has a recessed area 28 in which is disposed a wire end clamp 30. Wire end clamp 30 is preferably formed of a flat spring steel material which is affixed to base plate 24 by a pair of rivets 32. The free end of wire clamp mechanism 30 is located above the recessed portion of base plate 24 which has cutaway regions 34 on either side thereof. Wire clamp mechanism 30 has a V-shaped free end 38 which grasps an end 40 of a wire 42 wound about drum 22. Wire 42 is not shown in its entirety so as to simplify and thereby clarify the drawings. Wire end clamp 30 can be easily opened and is configured to handle any type of wire end preparation, such as a tinned end, contact end, lug end, or a 0.25 inch outer diameter cable end. Clamp 30 is either manually or mechanically opened during the wire loading step at the wire preparation station, and easily releases its grasp on wire end 40 when the gripper of a wire end-effector tool pulls on the wire end to place it into a holder on a formboard at a wire harness formation station.

Symmetrically disposed about the free end of drum 22 are four slots 46 which function as pivot slots for a plurality of lever arms 50 to be described later herein.

Figure 4:
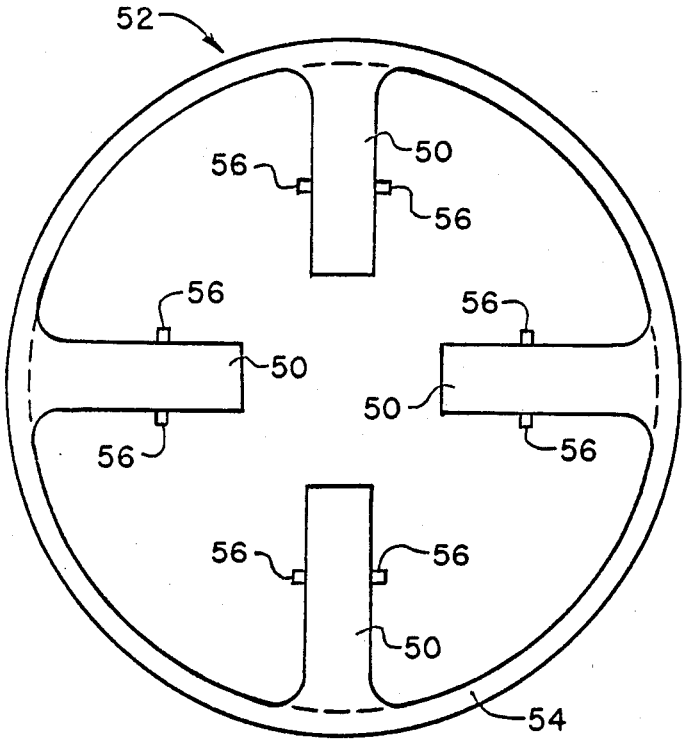
FIGS. 4 and 5 are orthogonal side and front views respectively of the shroud member of the wire container of the present invention.
Figure 5:
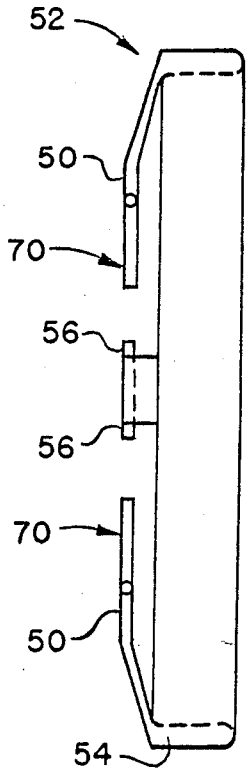

FIGS. 4 and 5 illustrate the preferred embodiment of the shroud member 52 of the container. Shroud member 52, which is also preferably formed of plastic material, comprises a rim 54 having four lever arms 50 which extend inwardly therefrom a part of the way toward the longitudinal axis of rim 52. Each lever arm 50 has a pair of axially aligned pivot pins 56 which project transversely therefrom about midway along their length.

Figure 6:
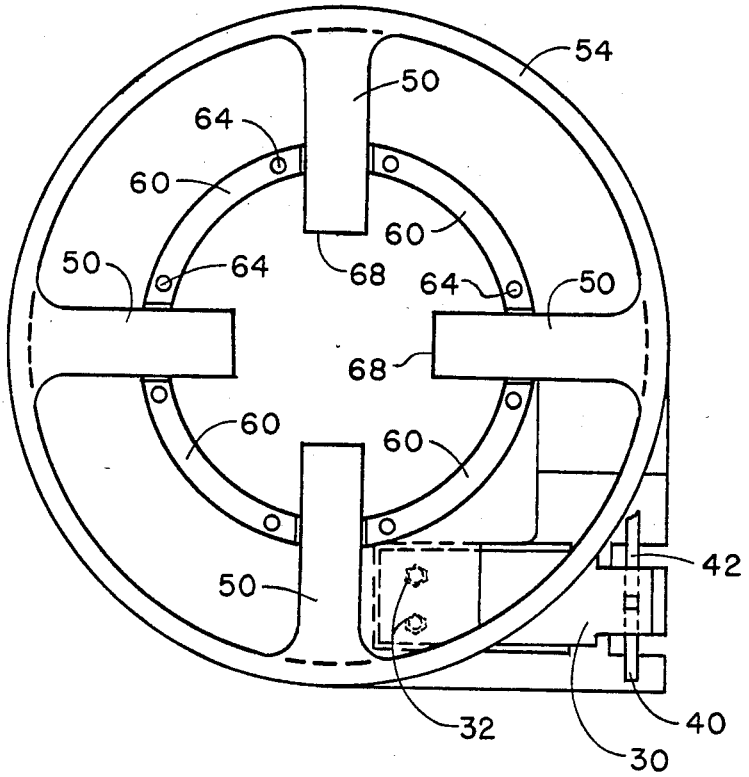
FIGS. 6, 7 and 8 are orthogonal side, front and bottom views respectively of the assembled wire container of the present invention.
Figure 7:
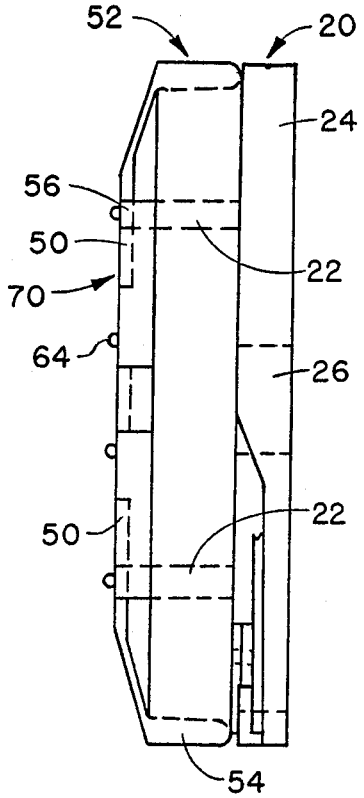
Figure 8:
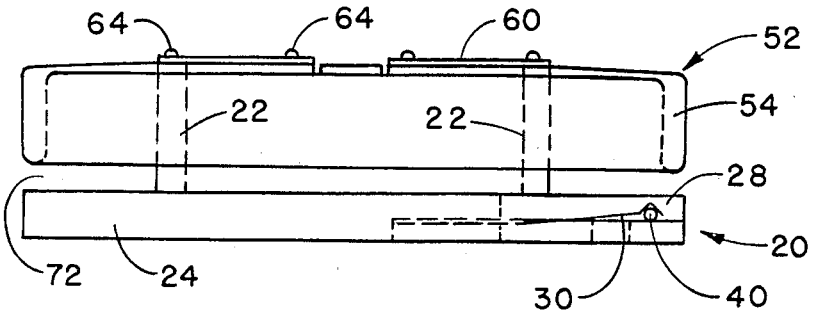

FIGS. 6, 7 and 8 are orthogonal views of the base member 20 and shroud member 52 when they are joined to form the container of the present invention. As seen in these views, the pivot pins 56 on lever arms 50 are inserted into the pivot slots 46 of base member 20. Pivot pins 56 are retained in pivot slots 46 by four mounting brackets 60 which are placed on top of drum 22 and over the pivot pins 56. Mounting brackets 60 may be affixed to the wall of drum 22 by conventional fasteners, such as screws 64, or may have holes therein which mate with studs that project from the wall of drum 22 and are deformed after the brackets have been placed over the studs to form heads thereon which hold the brackets in place.

FIG. 7 illustrates the closed position of the shroud 52 on base member 20. When force is applied to the free ends 68 of one or more of lever arms 50, such as near the point designated by the arrow 70, shroud 52 will be raised from the drum along the longitudinal axis thereof to expose a part of drum 22. This action provides a gap 72 as seen in FIG. 8, from which the wire 42 on drum 22 can be removed without damaging the trailing end of the wire or any contacts thereon.

Figure 9:
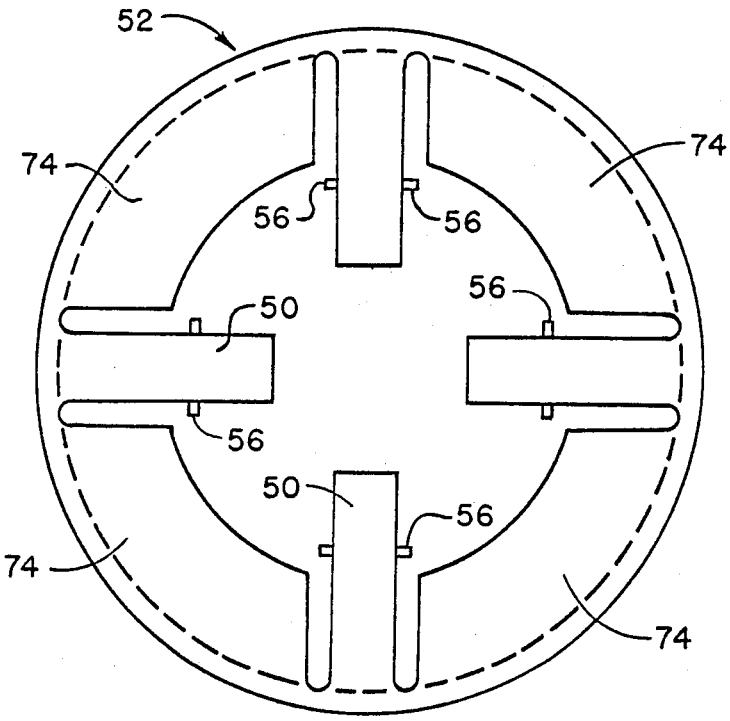
FIG. 9 is a side view of another embodiment of the shroud member of the present invention.

FIG. 9 illustrates an alternative embodiment of the shroud of the present invention. In this embodiment, rim 54 is extended inwardly between each of the lever arms 50 to form end shield members 74. End shield members 74 prevent the wire on drum 22 from escaping from or being damaged in the areas between lever arms 50.

Figure 10:
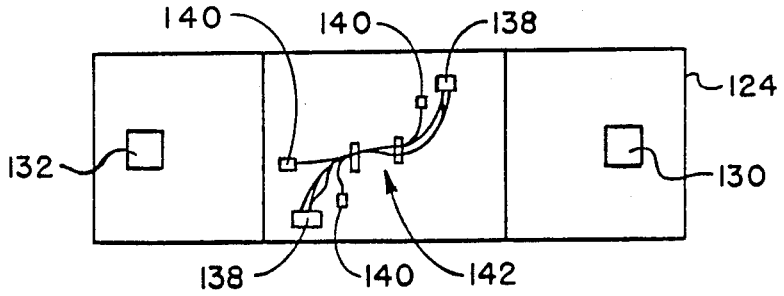
FIGS. 10 and 11 are elementary top and front views respectively of a two robot arm wire harness fabrication station.
Figure 11:
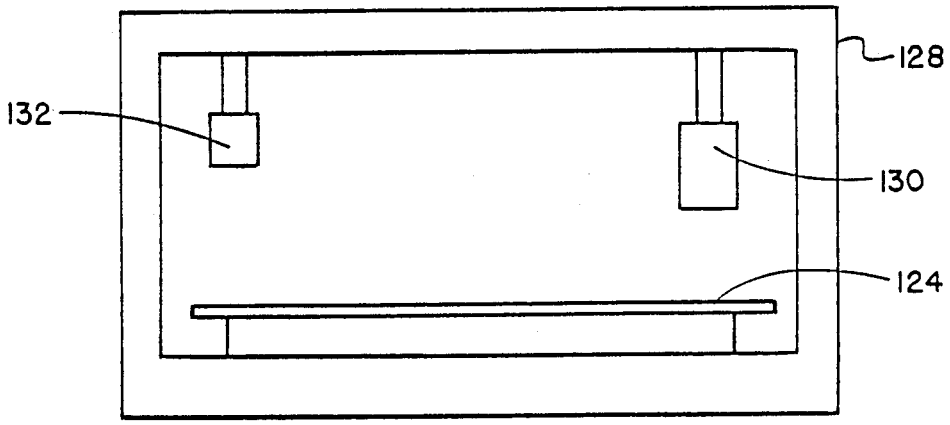

FIGS. 10 and 11 depict, in an elementary form, the formboard 124 and front view respectively of a wire harness fabrication station 128 which might utilize the wire container of the present invention. The station includes a first robot arm having a wire routing end-effector tool 130 affixed thereto and a second robot arm having a contact insertion end-effector tool 132 affixed thereto. Both of the tools are movable to any position above formboard 124 to route wires between various connectors 138 and wire end holders 140 to form a wire harness 142.

To form a wire harness, a container such a described herein is placed at a wire prep station. The container is then either manually or mechanically opened, that is to say the shroud 52 is raised from the surface of the base member 20 by the application of force to the lever arms 50 of the shroud, and a wire is manually or mechanically loaded into the container. The container is then closed and is transported to the wire harness formation station 128 where it is registered with and loaded onto the shaft of the wire routing end-effector tool 130. Wire routing end-effector tool 130 opens the container by applying a force to the lever arms 50 on the shroud 52 as the container is loaded on the tool. A gripper on the wire routing end-effector tool 130 removes the wire end 40 from the wire clamp mechanism 30 and places it into a holder 140 on formboard 134.

Although the container is usually open at this time and is free to rotate, it is possible to keep the wire container closed and stationary during most of the wire routing process. The container is opened however, at the time that the second wire end exits the container, to prevent damage to the second end of the wire and to any connectors thereon.

Wire routing end-effector 130 routes the wire along a predetermined two-dimensional path, until the known length of wire is routed. The container is then unloaded from the wire routing end-effector 130 and returned to the wire prep station. At this time, contact insertion end-effector 132 can be activated to retrieve wire ends having contacts thereon from their temporary holders 140 for insertion into appropriate connectors 138.

Although the invention has been described with reference to particular embodiments thereof, numerous adaptations and modifications of the invention will be apparent to those of skill in the art and hence it is intended by the appended claims to cover all such modifications and adaptations as fall within the spirit and scope of the invention.

What is claimed is:

1. Wire container apparatus comprising:

a base member and a shroud member;

said base member comprising a cylindrical drum with a base plate at a first end thereof, container mounting and registration means formed through said base plate in alignment with the longitudinal axis of said drum, wire clamping means recessed within said base plate, and a plurality of lever arm pivot slots in a second end of said drum;

said shroud member comprising a cylindrical rim having a plurality of lever arms projecting inwardly from an end of said rim and extending a part way towards the longitudinal axis of said rim, each of said plurality of lever arms having pivot means disposed in one of said plurality of pivot slots in said drum to secure said shroud member to said base member in a manner to permit axial movement therebetween upon the application of force to at least one of said plurality of lever arms.

2. Wire container apparatus as defined in claim 1 wherein said pivot means on each of said plurality of lever arms comprise a pair of axially aligned pins projecting from opposite sides thereof.

3. Wire container apparatus as defined in claim 2 wherein said pins on each of said plurality of lever arms are located substantially midway along the length thereof.

4. Wire container apparatus as defined in claim 3 wherein said plurality of pivot slots in said drum of said base member comprise four of said slots symmetrically disposed about said second end of said drum, and wherein said plurality of lever arms comprise four of said lever arms symmetrically disposed about the periphery of said rim of said shroud member.

5. Wire container apparatus as defined in claim 4 and further comprising bracket means affixed to said drum of said base member for retaining said pivot pins of said lever arms in said pivot slots of said drum of said base member.

6. Wire container apparatus as defined in claim 5 wherein said shroud member further comprises a plurality of end shield members extending from said rim and disposed between said plurality of lever arms.

* * * * *